US009684260B2

(12) United States Patent
Matsuura

(10) Patent No.: US 9,684,260 B2
(45) Date of Patent: Jun. 20, 2017

(54) IMAGE FORMING APPARATUS WITH CONTROL OF TRANSFER BIAS AND CHARGING BIAS

(71) Applicant: CANON KABUSHIKI KAISHA, Tokyo (JP)

(72) Inventor: Taisuke Matsuura, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/061,277

(22) Filed: Mar. 4, 2016

(65) Prior Publication Data

US 2016/0259264 A1 Sep. 8, 2016

(30) Foreign Application Priority Data

Mar. 5, 2015 (JP) ..... 2015-044096

(51) Int. Cl.

| | |
|---|---|
| ***G03G 15/00*** | (2006.01) |
| ***G03G 15/02*** | (2006.01) |
| ***G03G 15/06*** | (2006.01) |
| ***G03G 15/16*** | (2006.01) |
| *G03G 15/01* | (2006.01) |

(52) U.S. Cl.

CPC ..... *G03G 15/0266* (2013.01); *G03G 15/065* (2013.01); *G03G 15/1675* (2013.01); *G03G 15/0189* (2013.01); *G03G 15/5037* (2013.01)

(58) Field of Classification Search

CPC ..... G03G 15/0266; G03G 21/06; G03G 15/55
USPC ..... 399/48, 46, 66
See application file for complete search history.

(56) References Cited

U.S. PATENT DOCUMENTS

| | | | | |
|---|---|---|---|---|
| 5,600,421 | A * | 2/1997 | Takekoshi | G03G 15/0131 399/299 |
| 6,253,038 | B1 * | 6/2001 | Ito | G03G 15/0131 399/302 |
| 7,383,006 | B2 | 6/2008 | Matsuura | |

(Continued)

FOREIGN PATENT DOCUMENTS

| | | | |
|---|---|---|---|
| JP | 2003-302808 | A | 10/2003 |
| JP | 2014-153410 | A | 8/2014 |
| JP | 2015-38577 | A | 2/2015 |

OTHER PUBLICATIONS

U.S. Appl. No. 15/067,335, filed Mar. 11, 2016.

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

An image forming apparatus includes a photosensitive member, a charging member, a charging voltage source, an exposure device, a developing device, a developing voltage source, a transfer member, a transfer voltage source, a detecting member, a setting portion for setting, a transfer voltage applied to the transfer member on the basis of a detection result of the detecting member, and an adjusting portion for increasing a potential difference between the potential of the photosensitive member charged and the developing voltage so as to be large when an absolute value of the transfer voltage set by the setting portion is a first threshold or more and an absolute value of the current flowing at the time of application of the transfer voltage to the transfer member is a second threshold or less.

6 Claims, 10 Drawing Sheets

(56) References Cited

U.S. PATENT DOCUMENTS

| | | | | |
|---|---|---|---|---|
| 9,134,658 | B2 | 9/2015 | Matsuura | |
| 2012/0251139 | A1* | 10/2012 | Handa | G03G 15/0266 399/44 |
| 2013/0164010 | A1* | 6/2013 | Tanaka | G03G 15/0189 399/66 |
| 2014/0219671 | A1* | 8/2014 | Matsuura | G03G 15/1675 399/66 |
| 2016/0195837 | A1 | 7/2016 | Matsuura | G03G 15/1675 |

* cited by examiner

IMAGE FORMING APPARATUS WITH CONTROL OF TRANSFER BIAS AND CHARGING BIAS

FIELD OF THE INVENTION AND RELATED ART

The present invention relates to an image forming apparatus, such as a copying machine, a printer or a facsimile machine, using an electrophotographic type or an electrostatic recording type.

Conventionally, in an electrophotographic image forming apparatus, there are techniques such as a DC charging type and a pre-exposure-less type.

The DC charging type is the following technique. As a means for an electrophotographic photosensitive member, there is a type in which electroconductive charging member is brought in contact with or near o the photosensitive member and a voltage is applied to the charging member to perform a charging process (hereinafter referred to as a "contact charging type"). The charging process of the photosensitive member by the charging member is performed by electric discharge in a minute gap (spacing) between the charging member and the photosensitive member, and therefore to the charging member, a voltage of not less than a discharge threshold (charging start voltage) Vth is applied. At this time, there are two types consisting of an AC/DC charging type in which an oscillating voltage in the form of a DC voltage biased with an AC voltage is applied to the charging member and a DC charging type in which only the DC voltage is applied to the charging member. In the AC/DC charging type, the oscillating voltage in the form of the DC voltage, correspond to a desired charge potential VD of the photosensitive member, based with the AC voltage including a peak-to-peak voltage which is twice the discharge threshold Vth during DC voltage application is applied to the charging member. The AC/DC charging type has such an advantage that the desired charge potential VD is easily obtained by causing the potential of the photosensitive member to converge at the potential of the DC voltage on the basis of a potential smoothing effect by the AC voltage. On the other hand, the DC charging type has such an advantage that there is no need to use an AC voltage source, and therefore downsizing and cost reduction of the image forming apparatus can be realized.

The pre-exposure-less type is the following technique. There is a type in which with respect to a surface movement direction of the photosensitive member, downstream of a transfer portion and upstream of a charging portion, a pre-exposure means (discharging means) such as an LED chip array, a fuse lamp, a halogen lamp or a fluorescent lamp is provided and a residual electric charge of the surface of the photosensitive drum after a transfer step is removed. On the other hand, there is a pre-exposure-less type in which the pre-exposure means is omitted and the downsizing and cost reduction of the image forming apparatus are realized.

Japanese Laid-Open Patent Application 2003-302808 discloses an image forming apparatus having a simple constitution employing the above-described DC charging type and pre-exposure-less type.

However, in the image forming apparatus employing the DC charging type and the pre-exposure-less type, it turned out that a phenomenon of "positive ghost" is liable to generate. The positive ghost is roughly such a phenomenon that the charge potential at a portion correspond to an image on the photosensitive member becomes unstable and a toner in some amount is placed on a white background portion (non-image portion) of a subsequent image and appears as the image with a relatively large density.

According to study by the present inventor, it turned out that the positive ghost can be suppressed by causing a transfer current to flow in a sufficiently large amount. However, in some cases, the transfer current cannot be sufficiently increased depending on deterioration due to use of the transfer member and an environment of use (operation). This phenomenon can occur in the case where the transfer current cannot be still sufficiently increased even when a transfer bias, for electrostatically transferring a toner image from the photosensitive member onto a transfer-receiving member, applied from a constant voltage source reaches an upper limit of an output of the voltage source, for example. In such a case, the image forming apparatus employing the DC charging type and the pre-exposure-less type is disadvantageous in terms of t positive ghost for the following reason.

That is, in the AC/DC charging type, by the potential smoothing effect of the AC voltage, potential non-uniformity of the photosensitive member is smoothened (eliminated) when the photosensitive member is electrically charged and thus the photosensitive member charge potential is easily uniformized, and therefore the positive ghost does not readily generate. However, in the DC charging type, for such a reason that the potential smoothing effect of the AC voltage cannot be obtained, the DC charging type is disadvantageous against the positive ghost when compared with the AC/DC charging type.

Further, the pre-exposure device removes the potential on the photosensitive member after the transfer step and before a charging step and can uniformly cancel the photosensitive member surface potential before the charging step, and therefore the positive ghost does not readily generate. However, in the DC charging type, for such a reason that such a photosensitive member surface potential canceling effect cannot be obtained, the DC charging type is disadvantageous against the positive ghost when compared with the AC/DC charging type.

SUMMARY OF THE INVENTION

According to an aspect of the present invention, there is a provided an image forming apparatus comprising: a photosensitive member; a charging member for electrically charging the photosensitive member to a predetermined potential at a charging portion; a charging voltage source for applying a voltage to the charging member; an exposure device for exposing the photosensitive member to light to form an electrostatic image on the photosensitive member; a developing device, including a developing sleeve for carrying a toner, for supplying the toner to the electrostatic image on the photosensitive member to form a toner image; a developing voltage source for applying a developing voltage to the developing sleeve; a transfer member for forming a transfer portion where the toner image is transferred from the photosensitive member onto a transfer receiving member; a transfer voltage source for applying a voltage to the transfer member; a detecting member for detecting information on the voltage and a current when the voltage is applied to the transfer member; a setting portion for setting, on the basis of a detection result of the detecting member, a transfer voltage applied to the transfer member when the toner image is transferred from the photosensitive member onto the transfer receiving member at the transfer portion; and an adjusting portion for increasing a potential difference between the potential of the photosensitive member charged and the developing voltage so as to be large when an absolute value of the transfer voltage set by the setting portion is a first threshold or more and an absolute value of the current flowing at the time of application of the transfer voltage to the transfer member is a second threshold or less.

Further features of the present invention will become apparent from the following description of exemplary embodiments with reference to the attached drawings.

DESCRIPTION OF THE EMBODIMENTS

An image forming apparatus according to the present invention will be described with reference to the drawings.

[Embodiment 1]

1. General Structure and Operation of Image Forming Apparatus

Figure 1:
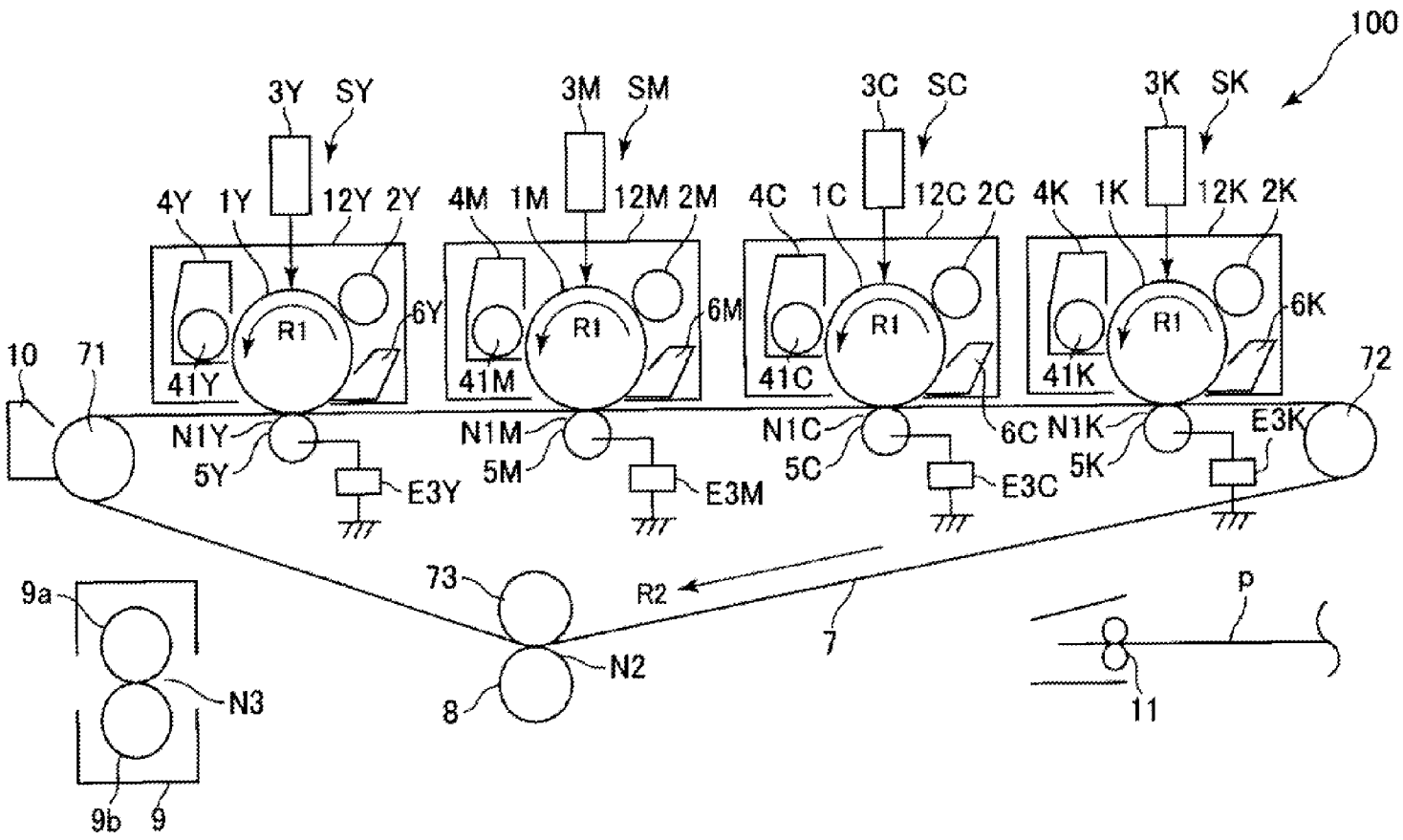
FIG. 1 is a schematic sectional view of an image forming apparatus.

FIG. 1 is a schematic sectional view showing a general structure of an image forming apparatus 100 in this embodiment according to the present invention.

The image forming apparatus 100 in this embodiment is a tandem-type printer which is capable of forming a full-color image using an electrophotographic type and which employs an intermediary transfer type.

The image forming apparatus 100 includes four image forming portions (stations) SY, SM, SC and SK which are arranged in a line with regular intervals and which form images of yellow (Y), magenta (M), cyan (C) and black (K), respectively.

Incidentally, in this embodiment, constituting and operations of the image forming portions SY, SM, SC, SK are substantially the same except that colors of toners used in a developing step are different from each other. Accordingly, in the following, in the case where particularly distinction is not required, suffixes Y, M, C and K for representing elements for associated colors, respectively, are omitted, and the elements will be collectively described.

At the image forming portion S, a photosensitive drum 1 which is a drum-shaped (cylindrical) electrophotographic photosensitive member as a movable image bearing member is provided. The photosensitive drum 1 is rotationally driven in an arrow R1 direction. At a periphery of the photosensitive drum 1, the following process means are provided in the listed order along a rotational direction of the photosensitive drum 1. First, a charging roller 2 which is a roller-shaped charging member as a charging means is disposed. Next, an exposure device 3 as an exposure means (image forming means) is disposed. Next, a developing device 4 as a developing means is disposed. Next, a primary transfer roller 5 which is a roller-shaped primary transfer member as a primary transfer means for transferring a toner image from the photosensitive member onto a transfer-receiving member at a transfer portion. Next, a drum cleaning device 6 as a photosensitive member cleaning means is disposed.

Further, as an intermediary transfer member, an intermediary transfer belt 7 changed by an endless belt is disposed opposed to the photosensitive drums 1Y, 1M, 1C, 1K of the image forming portions SY, SM, SC, SK. The intermediary transfer belt 7 is an example of a transfer-receiving member onto which the toner images are transferred. The intermediary transfer belt 7 is stretched by, as a plurality of stretching rollers (supporting rollers), a driving roller 71, a tension roller 72, and a secondary transfer opposite roller 73 with a predetermined tension, and are supported at an inner surface thereof by these rollers. The intermediary transfer belt 7 is rotationally driven in an arrow R2 direction in the figure by rotationally driving the driving roller 71.

In an inner peripheral (back) surface side of the intermediary transfer belt 7, at positions opposing the photosensitive drums 1Y, 1M, 1C, 1K, the above-described primary transfer rollers 5Y, 5M, 5C, 5K are disposed, respectively. Each of the primary transfer rollers 5 is urged against the intermediary transfer belt 7 toward the associated photosensitive drum 1, so that a primary transfer portion (primary transfer nip) N1 where the intermediary transfer belt 7 and the photosensitive drum 1 contact each other is formed. In an outer peripheral (front) surface side of the intermediary transfer belt 7 at a position opposing the secondary transfer opposite roller 73, the secondary transfer roller 8 which is a roller-shaped secondary transfer member as a secondary transfer means is disposed. The secondary transfer roller 8 is urged toward the secondary transfer opposite roller 73 via the intermediary transfer belt 7, so that a secondary transfer portion (secondary transfer nip) N2 which is a contact portion between the intermediary transfer belt 7 and the secondary transfer roller 8 is formed. Further, in the outer peripheral surface side of the intermediary transfer belt 7 at a position opposing the driving roller 71, a belt cleaning device 10 as an intermediary transfer member cleaning means is provided.

At each of the image forming portions, the photosensitive drum 1, and as process means actable on the photosensitive drum 1, the charging roller 2, the developing device 4 and the drum cleaning device 6 integrally constitute a process cartridge 12 detachably mountable to an apparatus main assembly of the image forming apparatus 100.

During image formation, a surface of the rotationally driven photosensitive drum 1 is electrically charged substantially uniformly by the charging roller 2 to a predetermined polarity (negative in this embodiment) and a predetermined potential. At this time, to the charging roller 2, a predetermined charging bias (charging voltage) is applied from a charging voltage source (high voltage source) E1 (FIG. 2) as a charging voltage applying means. The charged surface of the photosensitive drum 1 is subjected to scanning exposure to light depending on image information, correspond to the associated image forming portion S, by the exposure device 3, so that an electrostatic latent image (electrostatic latent image) is formed on the surface of the photosensitive drum 1. The electrostatic latent image is formed on the photosensitive drum 1 is developed (visualized) with a toner, of the color correspond to the image forming portion S, into a toner image by the developing device 4. At this time, to a developing sleeve 41 described later provided in the developing device 4, a predetermined developing bias (developing voltage) is applied from a developing voltage source (high voltage source) E1 (FIG. 2) as a developing bias applying means.

The toner image formed on the photosensitive drum 1 is transferred (primary-transferred) at the primary transfer portion N1 onto the rotationally driven intermediary transfer belt 7 by the action of the primary transfer roller 5. At this time, to the primary transfer roller 5, from a primary transfer voltage source E3 as a primary transfer bias applying means, a primary transfer bias (primary transfer voltage) which is a DC voltage of an opposite polarity (positive in this embodiment) to the charge polarity (normal charge polarity) of the toner during development is applied.

For example, during full-color image formation, the color toner images of yellow, magenta, cyan and black formed on the photosensitive drums 1Y, 1M, 1C and 1K of the image forming portions S are successively transferred (primary transferred) superposedly onto the intermediary transfer belt 7 at the primary transfer portions N1Y, N1C, N1K, respectively.

The toner images transferred on the intermediary transfer belt 7 are transferred (secondary-transferred) onto the recording material (transfer material, recording medium) P such as a recording sheet by the action of the secondary transfer roller 8. At this time, to the secondary transfer roller 8, from an unshown secondary transfer voltage source (high voltage source) as a secondary transfer belt applying means, a secondary transfer bias (secondary transfer voltage) which is a DC voltage of an opposite polarity (positive in this embodiment) to the charge polarity of the toner during development is applied. The recording material P is fed to the secondary transfer portion N2 in synchronism with the toner images on the intermediary transfer belt 7 by a recording material feeding roller 11 and the like.

The recording material P on which the toner images are transferred and which is separated from the secondary transfer roller 8 is fed to the fixing device 9 as a fixing means and is heated and pressed at a fixing portion (fixing nip) N3 between a fixing roller 9*a* and a pressing roller 9*b* of the fixing device 9, so that the toner images are fixed on the recording material P. After the toner images are fixed, the recording material P is discharged to an outside of an apparatus main assembly of the image forming apparatus 100.

Further, a toner (transfer residual toner) remaining on the surface of the photosensitive drum 1 without being completely transferred onto the intermediary transfer belt 7 at the primary transfer portion N1 is removed from the surface of the photosensitive drum 1 by the drum a cleaning device 6 and is collected.

The toner (secondary transfer residual toner) and paper dust remaining on the surface of the intermediary transfer belt 7 without being completely transferred onto the recording material P at the secondary transfer portion N2 is removed from the surface of the intermediary transfer belt 7 by the belt cleaning device 10 and is collected.

The image forming apparatus 100 in this embodiment employs a DC charging type in which the surface of photosensitive drum 1 is electrically charged by applying only a DC voltage from the charging voltage source E1 (FIG. 2) to the charging roller 2. For this reason, there is no need to provide an AC voltage source separately from the DC voltage source, different from the case of an AC/DC charging type, and therefore a structure of the image forming apparatus 100 can be simplified to suppress an increase in cost. Further, the image forming apparatus 100 employs a pre-exposure-less type, i.e., does not include a pre-exposure device as a pre-exposure means (discharge means), for removing a residual electric charge on the surface of the photosensitive drum 1 after the transfer step, at a position downstream of the primary transfer portion N1 upstream of a charging portion of the charging roller 2 with respect to a surface movement direction of the photosensitive drum 1. For this reason, there is no need to provide a pre-exposure device (charge-removing device), and there is also no need to provide a dedicated power (voltage) source and a mounting structure. Therefore, the number of parts is reduced, so that it is possible to obtain an effect such that the image forming apparatus 100 can be decreased in size and cost.

In this embodiment, the photosensitive drum 1 is a negatively chargeable organic photoconductor (OPC) of 30 mm in outer diameter. This photosensitive drum 1 is rotationally driven in general at a process speed (peripheral speed) of 200 mm/sec in an arrow R1 direction in FIG. 1 by a drum driving motor M1 (FIG. 2) as a photosensitive member driving means. An abrasion amount of the photosensitive drum 1 by repetition (endurance) of image formation varies depending on the charging type. In the DC charging type, the abrasion amount is about 1 μm/10000 sheets. In the AC/DC charging type, the abrasion amount is about 3 μm/10000 sheets. Compared with the AC/DC charging type in which a discharge current is large, the DC charging type in which the abrasion amount of the photosensitive drum 1 is small is advantageous in terms of prolongation of a lifetime of the photosensitive drum 1.

In this embodiment, the charging roller 2 is 320 mm in length with respect to a longitudinal direction (rotational axis direction) and has a three-layer structure in which around a stainless steel core metal of 6 mm in diameter, consisting of a lower layer, an intermediate layer and a surface layer are laminated. The lower layer is a foamed sponge layer of carbon-dispersed EPDM and is $10^2$-$10^9\Omega$ in volume resistance value (electric resistance value) and 3.0μ in layer thickness. The intermediate layer is formed with carbon-dispersed NBR rubber and is $10^2$-$10^5\Omega$ in volume resistance value and 700 μm in layer thickness. The surface layer is constituted by dispersing tin oxide and carbon black in a resin material of a fluorine-containing compound and is a protective layer of $10^7$-$10^{10}\Omega$ in volume resistance value. A volume resistance value of a whole of the charging roller 2 is $10^5\Omega$.

The charging roller 2 is urged toward a rotation center of the corresponding photosensitive drum 1 by an unshown spring as an urging member to be press-contacted to the surface of the photosensitive drum at a predetermined urging force, and is rotated by rotation of the photosensitive drum.

In this embodiment, as the exposure device 3, a laser scanner device for scanning the surface of the photosensitive drum 1 with laser light modulated depending on image information along the longitudinal direction (rotational axis direction) of the photosensitive drum 1 was used.

In this embodiment, as the developing device 4, a two-component developing device employing a two-component developing type using, as the developer, a two-component developer principally consisting of non-magnetic toner particles 8 toner) and magnetic carrier particles (carrier) was used. The developing device 4 feeds the developer to an opposing portion (developing portion) to the photosensitive drum 1 by the developing sleeve 41 as a rotatable developer carrying member (developing member). By applying a developing bias to the developing sleeve 41, the toner is transferred from the developer on the developing sleeve 41 onto the photosensitive drum 1. In this embodiment, the developing bias in the form of a negative DC voltage component Vdc biased with an AC voltage component is applied. In this embodiment, the charge polarity (normal charge polarity) of the toner portion development is negative. In this embodiment, the developing device forms the toner image by a reverse development type. The reverse development type is such a development type that the toner charged to the same polarity as the charge polarity of the photosensitive member is supplied to the exposed portion (image portion) of the photosensitive member surface which is uniformly charged and thereafter is lowered in absolute value of the potential by being exposed to light depending on the image information. In the developing devices 4Y, 4M, 4C, 4K, as the toners, toners of colors of yellow, magenta, cyan, black are accommodated, respectively.

In this embodiment, the primary transfer roller 5 is 320 mm in length with respect to the longitudinal direction (rotational axis direction). This primary transfer roller 5 is prepared by forming a foam sponge as an elastic layer around a stainless steel-made core metal of 8 mm in diameter. This primary transfer roller 5 is constituted as, for example, a roller of $5\times10^5$-$1\times10^6\Omega$ in volume resistivity value and 16 mm in diameter. Further, in this embodiment, the primary transfer roller 5 is constituted using an ion-conductive foam sponge. In this embodiment, as a material for the foam sponge (foam roller), nitrile-butadiene rubber (NBR) containing an ion-conductive substance as an electroconductive material was used. The primary transfer roller 5 is a roller using the ion-conductive material, and therefore, electroconductivity thereof is influenced by an environmental factor such as a temperature or humidity, so that an electric resistance value is liable to largely change.

In general, as a material for the transfer roller as a transfer member, not only a polymethane foam roller or a nitrile-butadiene rubber (NBR) foam roller containing an ionic substance but also the following roller or the like is used. That is, an ethylene-propylene-dien rubber (EPDM) foam roller or the like in which electroconductive powder such as carbon black is dispersed is used. With respect to the roller using carbon black as the electroconductive member, it is difficult to adjust a stable dispersing property and a non-uniformity in electric resistance value, so that in some cases, it is difficult to maintain a stable electric resistance value within a fluctuation in one digit in mass production. On the other hand, the roller using the ion-conductive material has such an advantage that a stable electric resistance value is easily obtained. For that reason, for example, in an image forming apparatus in which the toner image is transferred onto a transfer-receiving member under application of a constant voltage at a transfer portion, as the transfer member, a roller which is inexpensive and easy to adjust the electric resistance and which uses the ion-conductive foam sponge is used. On the other hand, the ion-conductive agent is easily mixed with a rubber uniformly, but has a moisture absorption property and the electroconductivity is influenced by an environmental factor such as the temperature or the humidity, so that the electric resistance value largely changes in some cases. Specifically, in a low-temperature and low-humidity environment, the electric resistance value is several hundreds of times the electric resistance value in a normal environment. Further, in some cases, with respect to the roller using the ion-conductive material, localization of the ion-conductive material generates by continuation of energization, so that an electric resistance value of the roller increases in some cases.

Figure 3:
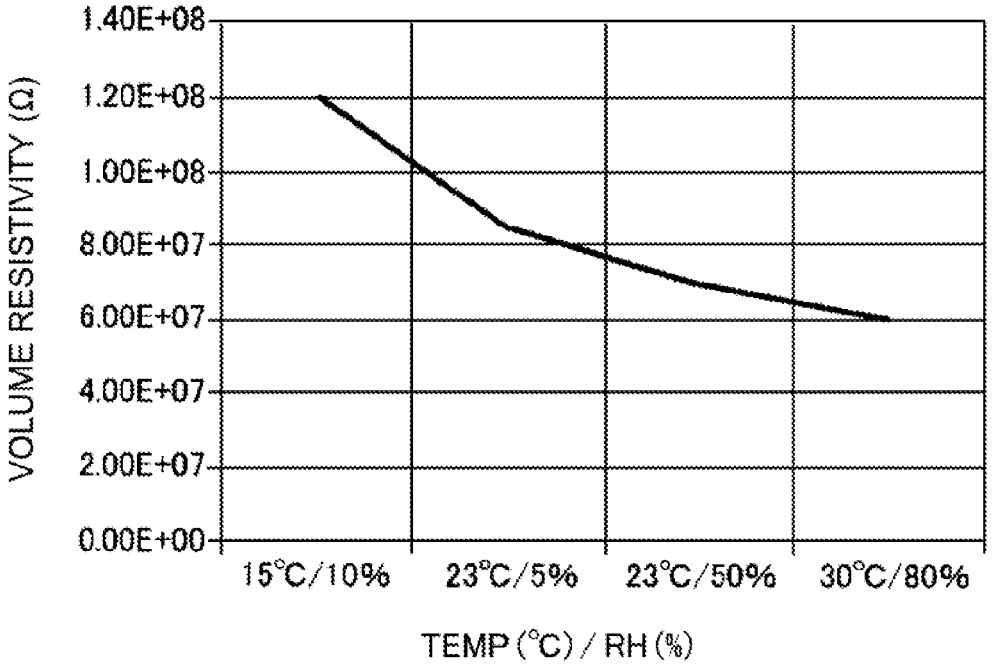
FIG. 3 is a graph showing a volume resistance value of a primary transfer roller in each of environments.

FIG. 3 shows a volume resistance value of the primary transfer roller 5 used in this embodiment in each of temperature-relative humidity environments. As shown in FIG. 3, the electric resistance value of the primary transfer roller 5 increases from in 30° C./80% environment toward in 15° C./10% (low temperature/low humidity) environment.

Figure 4:
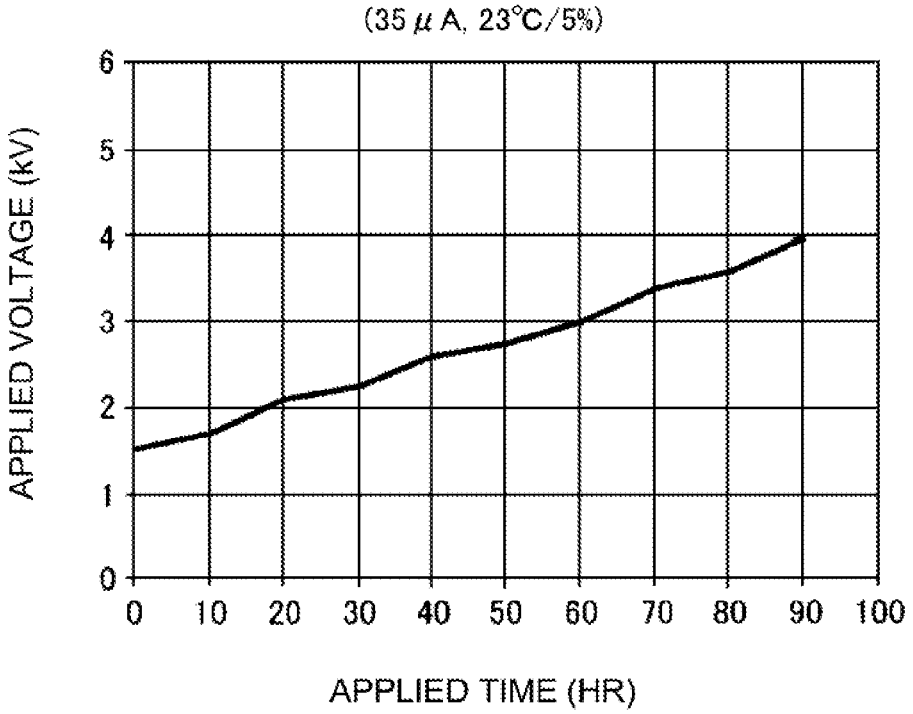
FIG. 4 is a graph showing a change in applied voltage, when the potential is rotated under energization.

FIG. 4 shows progression of the electric resistance value of the primary transfer roller 5 used in this embodiment in the case where an energization black rotation test is conducted. FIG. 4 shows a change, with bias application time, of a value of a voltage necessary to obtain a predetermined current. Specifically, the test was conducted in an environment of 23° C./5% in such a manner that the primary transfer roller 5 was rotated at a speed of 200 mm/sec while applying a pressure of 1000 gf in weight to an aluminum-made drum of 30 mm in diameter. Then, value of voltages necessary to obtain a current value of 35 μA when the current value of 35 μA was continuously applied by an external high voltage source capable of applying a constant current were plotted. As shown in FIG. 4, compared with an initial stage, by continuation of the energization, the voltage value necessary to obtain the same current value increases. Thus, the electric resistance value of the primary transfer roller 5 gradually increases by the energization due to repetition of the image formation.

2. Control Mode

Figure 2:
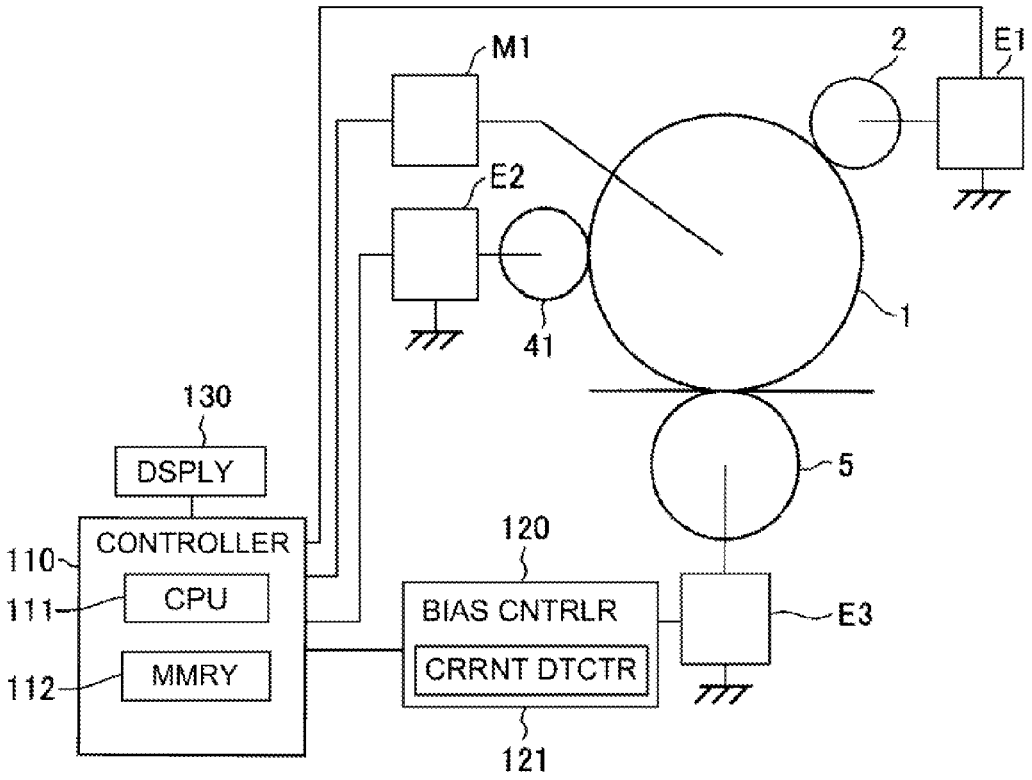
FIG. 2 is a block diagram showing a schematic control made of a principal part of the image forming apparatus.

FIG. 2 shows a schematic control mode of a principal part of the image forming apparatus 100 in this embodiment. The controller 110 is constituted by including a CPU 111 as a control means which is a central element for performing an operation process (computation) and a memory (storing medium) 112, such as ROM or RAM, as a storing means. In the RAM which is a rewritable memory, information inputted into the controller 110, detected information, a computation (operation) result and the like are stored, and in the ROM, a data table acquired in advance and the like are stored. The CPU 111 and the memory 112 such as the ROM or the RAM are capable of transfer and reading of data therebetween.

With the primary transfer roller 5, the primary transfer voltage source (high voltage circuit) E3 is connected. With the primary transfer voltage source E3, a bias controller (bias control circuit) 120 for controlling the bias applied to the primary transfer roller 5 by the primary transfer voltage source E3 under control of the CPU 111 by the controller 110. This bias controller 120 is provided with a current detecting circuit 121 for detecting a value of a current flowing when the bias is applied to the primary transfer roller 5 by the primary transfer voltage source E3. The bias controller 121 causes the bias of a predetermined voltage value set under control of the CPU 111 by the controller 110 to output from the primary transfer voltage source E3. Further, the bias controller 120 detects the value of the current, flowing when this predetermined bias is outputted, by a current detecting circuit 121. As a result, the bias controller 120 is capable of detecting a value of a voltage outputted by the primary transfer voltage source E3 and a value of a current flowing through the primary transfer voltage source E3 when the bias is applied to the primary transfer roller 5 by the primary transfer voltage source E3 as a detecting means.

The primary transfer voltage source E3 in this embodiment is not provided with a constant-current circuit but is provided with only a constant-voltage circuit, of the constant-current circuit and the constant-voltage circuit, for the purpose of cost reduction and the like. For that reason, in this embodiment, as control for determining a condition of the bias applied to the primary transfer roller 5 for the primary transfer by the primary transfer voltage source E3, as described specifically later, PTVC control effected by the constant-voltage circuit is used. A range of an output value of the primary transfer voltage source E3 in this embodiment is 0-3.5 kV. That is, a range of a voltage value correspond to a target current value, necessary for the primary transfer, determined by the PTVC control described specifically later is 0-3.5 kV.

With the controller 110, a display portion (display) 130, as a notifying means for providing notification of information to an operator, provided at an operating portion provided on the apparatus main assembly of the image forming apparatus 100 is connected.

In addition, with the controller 110, many portions-to-be-controlled relating to the image formation including the drum driving motor M1, the charging voltage source E1 and the developing voltage source E2 are connected.

In FIG. 2, for simplification, a single image forming portion S where the charging voltage source E1, the developing voltage source E2, the primary transfer voltage source E3, the bias controller 120 and the drum driving motor M1 are provided is illustrated. However, in this embodiment, at least the charging voltage source E1, the developing voltage source E2, the primary transfer voltage source E3 and the bias controller 120 are provided for each of the image forming portions S.

The controller 110 effects integrated control of the respective portions of the image forming apparatus 100 to perform a sequence operation. Into the controller 110, an image forming signal (image data, control instruction) is inputted from an external host device (not shown) such as an image reading device or a personal computer, and in accordance with this image forming signal, the controller 110 controls the respective portions of the image forming apparatus 100, so that an image forming operation is executed. In this embodiment, the controller 110 has the function as a setting means for setting (determining) the value of the bias voltage applied for transfer to the primary transfer roller 5 by the primary transfer voltage source E3. Further, in this embodiment, the controller 110 has the function as an adjusting means for adjusting a back contrast for suppressing the positive ghost described below.

3. Positive Ghost

The image forming apparatus employing the DC charging type and the pre-exposure-less type is advantageous in terms of simplification and cost reduction of the structure of the image forming apparatus by omitting the AC voltage source for superposing the charging bias with the AC voltage and the pre-exposure device (charge-removing device). In this image forming apparatus, however, as described above, the positive ghost is liable to occur. Here, the positive ghost will be described specifically. For convenience, a large-small relationship and a high-low relationship of the voltages and the potentials will be described as those in the case where the values of the voltages and the potentials are compared on an absolute value basis. In the following, the primary transfer is described simply as the transfer in some cases.

In the case employing the reversal development type using the toner having the negative polarity as the normal charge polarity, for example, the photosensitive drum 1M charged to the negative polarity at the second image forming portion SM receives a positive transfer bias at the primary transfer portion N1M, so that the negative potential at the surface thereof is lowered. Thereafter, when the photosensitive drum 1M is rotated and a surface thereof passes through the charging portion by the charging roller 2M again, the photosensitive drum surface is electrically charged again to a charge potential (dark portion potential) VD by the charging roller 2 (hereinafter also referred to as re-charging).

Figure 5:
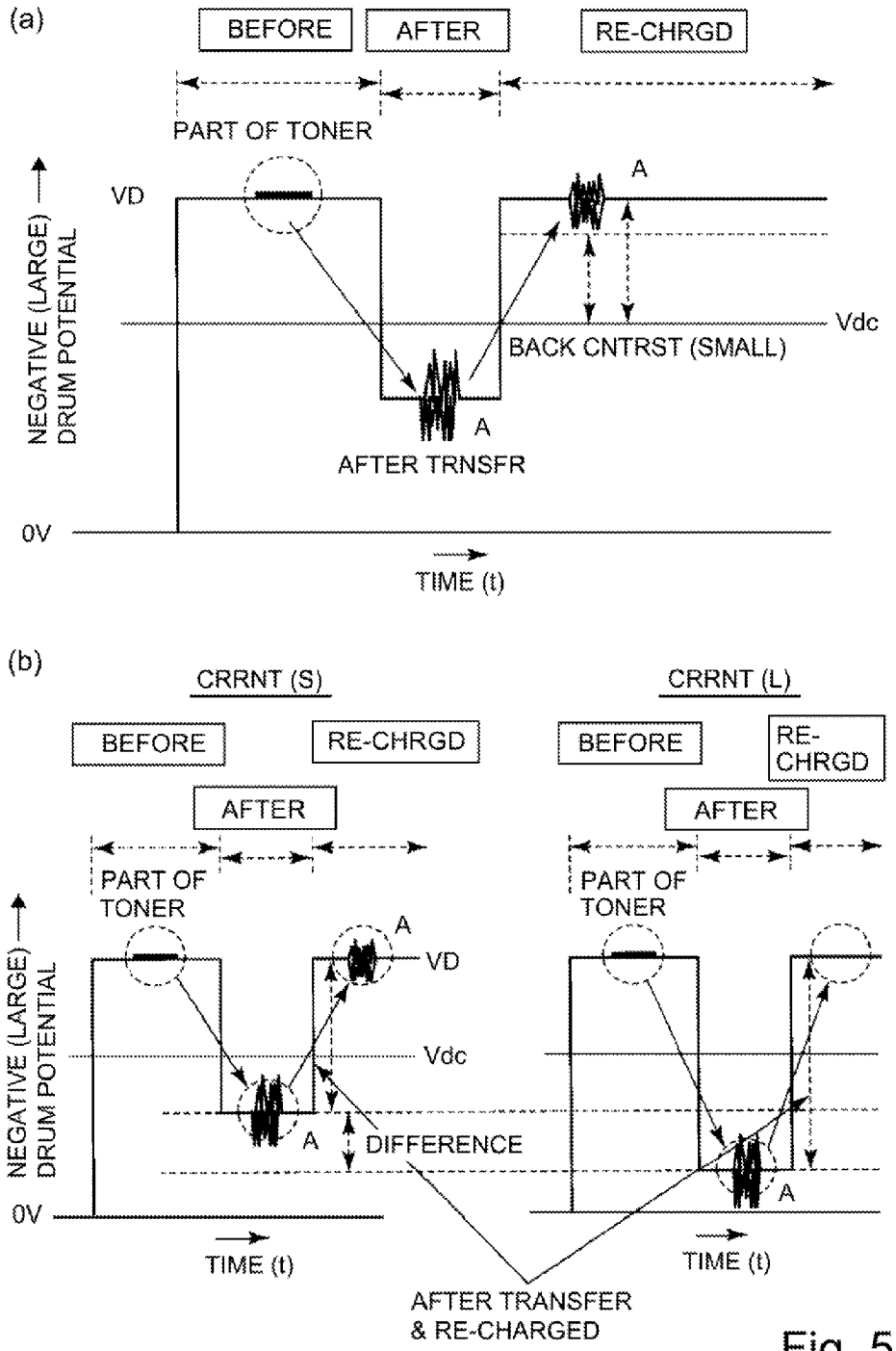
In FIG. 5, (a) and (b) are schematic views for illustrating a positive ghost.

In this case, as shown in (a) of FIG. 5, when the toner image exists at the primary transfer nip portion N1M, in some cases, the surface potential of the photosensitive drum 1M, after passed through the primary transfer portion N1M, at a portion correspond to the toner image causes minute potential non-uniformity A. This minute potential non-uniformity A is generated by an occurrence of electric discharge in a minute space between the deposited toner image and the photosensitive drum 1M when the primary transfer bias is applied to the photosensitive drum via the toner image.

The portion on the photosensitive drum 1M where the minute potential non-uniformity A is generated is thereafter electrically charged again, but in the case where the potential non-uniformity A cannot be eliminated even when the photosensitive drum portion is electrically charged again, and the toner image T remains on the photosensitive drum portion, the following phenomenon occurs. That is, in the case where the portion of the potential non-uniformity A is a white background portion (charge potential VD portion), a back contrast which is a potential difference between the charge potential VD and the developing bias Vdc cannot ensured sufficiently to cause a positive ghost which is fog at the white background portion. The fog refers to deposition of the toner at a portion where the toner should not be originally deposited on the photosensitive member.

The positive ghost is liable to appear at a higher density with an increasing amount of the toner passing through the primary transfer portion N1M. This is because a gap between the toner image and the photosensitive drum 1M increases and the potential non-uniformity due to the electric discharge becomes large, and therefore the amount of the fog toner on the white background portion becomes large.

The positive ghost can be suppressed by increasing a transfer current to be supplied (applied) to the primary transfer portion N1, so that the positive ghost can be caused to be reduced to a level of no problem or to disappear by sufficiently applying the transfer current. This was found by an experiment of the present inventor.

The reason therefor is that by sufficiently increasing the primary transfer bias to pass the transfer current in a sufficiently large amount through the photosensitive drum 1, the charging current necessary to uniformly re-charge the photosensitive drum surface where the potential non-uniformity resulting in the positive ghost is generated can be obtained. The charging current is a current generated in the case where the surface of the photosensitive drum 1 is charged to the charge potential VD by output of a high voltage applied to the charging member such as the charging roller 2.

In FIG. 5, (b) schematically shows a difference in potential non-uniformity depending on the magnitude of the transfer current when the potential non-uniformity portion of the surface of the photosensitive drum 1 after the transfer step is re-charged. In the case where the transfer current is large (right side of (b) of FIG. 5), the surface potential of the photosensitive drum 1 after the transfer step is largely lowered toward 0 V compared with the case where the transfer current is low (left side of (b) of FIG. 5), Accordingly, in the case where the surface of the photosensitive drum 1 is re-charged to the charge potential VD, when the transfer current is large, a larger potential difference relative can be provided between the surface potential of the photosensitive drum 1 before the charging process and the charge potential VD, and therefore a larger charging current can be obtained. When this potential difference is small, the electric field enough to uniformize the potential non-uniformity A cannot be obtained, so that the potential non-uniformity A cannot be eliminated. Further, at a portion of the photosensitive drum 1 where the potential non-uniformity A generates, the positive ghost generating due to a partial decrease in back contrast generates. On the other hand, in the case where the potential difference is sufficiently large, the surface of the photosensitive drum 1 can be uniformly charged by the electric field enough to uniformize the non-uniformity A. As a result, the occurrence of the positive ghost caused due to the partial decrease in back contrast can be prevented effectively.

For that reason, in general, by transfer bias control as described later, a set value of such a primary transfer bias that the transfer current necessary to suppress the occurrence of the positive ghost can be obtained is given.

4. Transfer Belt Control

Next, a transfer bias control method will be described. As the transfer bias control method, there are types which are called an ATVC type and a PTVC type. These types are such a type that in the case where toner images are transferred from the photosensitive members onto the transfer-receiving member under application of a constant voltage to the transfer portion, voltages are applied to the transfer portion in advance of the image formation and currents flowing through the transfer portion are measured and then a voltage condition used at the transfer portion during the image formation is set. In the ATVC (active transfer voltage control) type, to the transfer portion through which the toner image does not pass, a constant current correspond to a current value necessary to transfer the toner image during the image formation is supplied (applied), so that an output voltage value is measured. Then, on the basis of a measurement result, a value of a voltage applied to the transfer member during the image formation is set. In the PTVC (programmable transfer voltage control), to the transfer portion through which the toner image does not pass, constant voltages of a plurality of levels are applied, so that values of currents flowing through the transfer member correspondingly to the constant voltages of the plurality of levels are measured. Then, from voltage-current data of a plurality of levels, an output voltage correspond to a current value necessary to transfer the toner image during the image formation is subjected to an interpolation computation, and on the basis of a computation result, a constant voltage used during the image formation is set. At this time, the current value, necessary to transfer the toner image, as a target transfer current used for the image formation is set in accordance with a transfer current value table set in advance correspondingly to the toner charge amount varying depending on a temperature and humidity in an environment in which the image forming apparatus is placed.

In the ATVC type, detection of information on the electric resistance of the transfer means (transfer member) is made by constant-current control, whereas in the PTVC type, the detection is made by only constant-voltage control. For that reason, when the PTVC type is used, a circuit is simplified and detection accuracy is easily improved. In this embodiment, for the purpose of cost reduction or the like, the primary transfer voltage source E3 is not provided with a constant-current circuit. Accordingly, as the transfer bias control method, the PTVC type is used.

Determination of transfer bias voltage value (transfer voltage value) by the PTVC is made at predetermined timing during non-image formation. As during non-image formation, the following periods can be cited. The periods include during pre-multi-rotation in which a preparatory operation performed during turning-on of a main switch of the image forming apparatus or during restoration from a sleep mode of the image forming apparatus is executed. The periods include during pre-rotation in which a predetermined preparatory operation is executed from input of an image formation start instruction until an image depending on image information is actually written out (formed). The periods include a paper (sheet) interval correspond to an interval between a recording material and a subsequent recording material during continuous image formation. The periods include during post-rotation in which a predetermined post-operation (preparatory operation) is executed after the image formation is ended. As the predetermined timing, it is possible to cite during pre-rotation, during post-rotation, at the paper interval and the like which are executed for each of predetermined number of sheets subjected to the image formation (predetermined print number). In this embodiment, the determination of the transfer voltage value by the PTVC is made during pre-rotation or at the paper interval for each of integrated print number of 100 sheets.

The primary transfer roller 5 increases in electric resistance value by being subjected to repetition of the image formation or by being placed in a low-temperature/low-humidity environment. For that reason, particularly, in the case where the electric resistance increases by the repetition of the image formation or in a further low-temperature/low-humidity environment, the calculated voltage value (transfer voltage value) correspond to the target current value necessary for the predetermined transfer is larger than an upper limit of an output of the primary transfer voltage source E3 in some cases. However, the upper limit of the output of the primary transfer voltage source E3 is, for example, 3.5 kV in this embodiment, and therefore the calculated voltage value cannot be outputted. For that reason, in that case, the upper limit, i.e., 3.5 kV is outputted. As a result, a transfer current value correspondingly to an insufficient voltage with respect to the voltage value correspond to the target current value necessary for the primary transfer is sufficient. Further, in the image forming apparatus 100 employing the DC charging type and the pre-exposure-less type as in this embodiment, when the transfer current value is smaller than a predetermined value, the positive ghost is liable to generate.

Therefore, in this embodiment, in a manner described specifically later, the transfer current value is smaller than the predetermined value, and thus in the case where there is a possibility that the positive ghost generates, control for suppressing the positive ghost is effected.

5. Suppression of Positive Ghost

Next, control for suppress the positive ghost in this embodiment (hereinafter positive ghost suppressing control) will be described. In this embodiment, an operation of this positive ghost suppressing control is substantially common to all of the image forming portions SY, SM, SC, SK, and therefore description will be made by pay attention to a single image forming portion S.

In this embodiment, on the basis of the transfer voltage value determined by the PTVC control and a result of detection by the current detecting circuit 121 when the primary transfer bias having the transfer voltage value is applied, the positive ghost suppressing control is executed.

In this embodiment, as the positive ghost suppressing control, even when the transfer current value is smaller than the predetermined value and a situation in which the positive ghost is liable to generate is formed, back contrast adjustment (hereinafter referred also to as "VD offset") is effected so that the fog at the white background portion can be suppressed.

Figure 6:
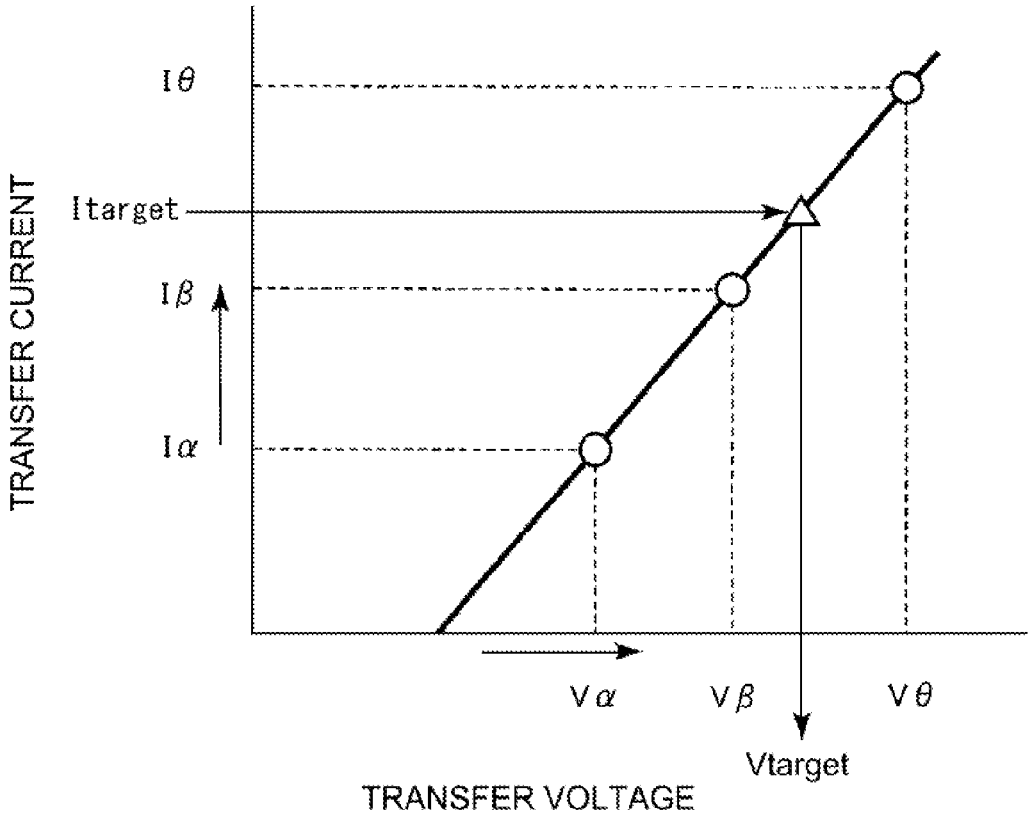
FIG. 6 is a graph for illustrating PTVC control.

First, using FIG. 6, the PTVC in this embodiment will be described specifically. FIG. 6 is a schematic view showing a relationship between a voltage value and a current value (voltage-current characteristic) measured in the PTVC.

In a period in which the toner image does not pass through the primary transfer portion N1, voltages Vα, Vβ, Vθ of a plurality of different potential levels are applied, and then currents Iα, Iβ, Iθ positive ghost at that time are detected by the current detecting circuit 121. Then, from the voltage-current characteristic, a target voltage value (Vtarget) correspond to a target current value (Itarget) necessary to the primary transfer is subjected to interpolation computation. In the case where a calculation value of the target voltage value (Vtarget) exceeds 3.5 kV which is the upper limit of the output of the primary transfer voltage source E3, the upper limit (3.5 kV) is determined as the transfer voltage value (height voltage set value of the primary transfer bias). In the case where the calculation value of the target voltage value (Vtarget) is not more than 3.5 kV which is the upper limit of the output of the primary transfer voltage source E3, the calculation value is determined as the transfer voltage value (high voltage set value of the primary transfer bias). In this embodiment, the controller 110 as a setting means effects control of an acquiring operation of the voltage-current characteristic in the PTVC and calculation and setting (determination) of the transfer voltage volume in the PTVC which are as described above. Incidentally, during the PTVC, a region of the photosensitive drum 1 positive ghost through the primary transfer portion N1 when the primary transfer bias is applied to the primary transfer roller 5 is electrically charged at a set value of the charging bias set at that time.

Figure 7:
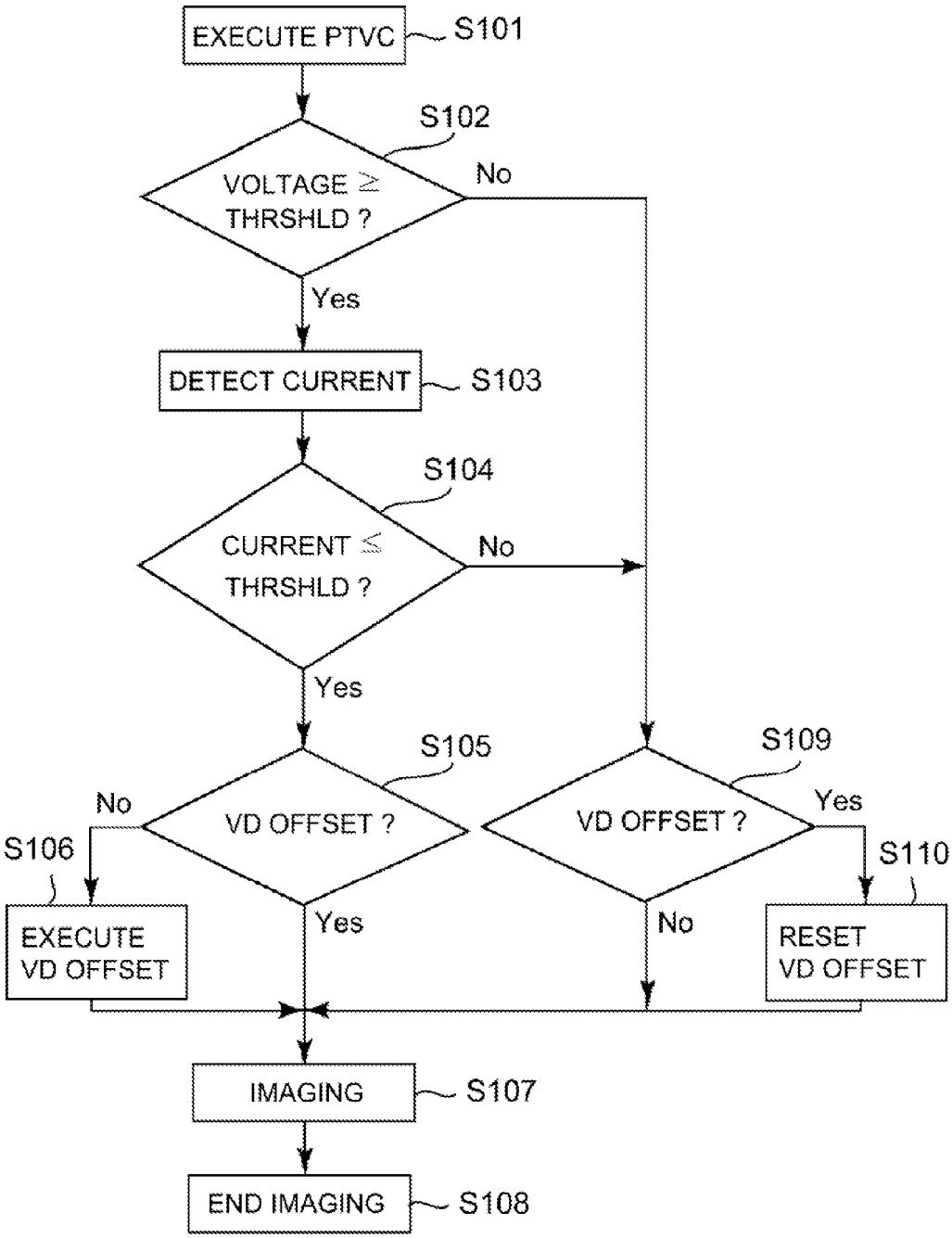
FIG. 7 is a flowchart of an operation in Embodiment 1.

Next, using a flowchart of FIG. 7, an outline of a flow of the operation of the image forming apparatus including the positive ghost suppressing control in this embodiment will be described.

First, the controller 110 executes the PTVC in advance of the image formation (S101). Then, the controller 110 discriminates whether or not the transfer voltage volume (high voltage set value of the primary transfer bias) determined by the PTVC is not less than a predetermined first threshold (S102). Specifically, in this embodiment, whether or not the target voltage value (Vtarget) correspond to the target current value (Itarget) calculated in the PTVC is not less than 3.5 kV which is the upper limit of the output of the primary transfer voltage source E3 is discriminated. Thus, in this embodiment, the first threshold is 3.5 kV which is the upper limit of the output of the primary transfer voltage source E3, but is not limited thereto, and the first threshold may also be a value not less than the upper limit value of the output of the primary transfer voltage source E3.

In S102, in the case where the discrimination is made as "Yes" (the transfer voltage volume of not less than 3.5 kV), the controller 110 subsequently continued application of the primary transfer bias having the transfer voltage volume determined in the PTVC in S101. At this time, also the charging process at the charging bias set value sets at that time is continued. Then, the controller 110 detects the transfer current value in this state by the current detecting circuit 121 (S103).

Then, the controller 110 discriminates whether or not the transfer current value detected by the current detecting circuit 121 is not more than a predetermined second threshold (S104). In this embodiment, for the reason described later, the second threshold was set at 10 μA. Thus, whether or not the transfer current value immediately before an image region when the primary transfer bias having the transfer voltage volume determined in the PTVC is applied is not more than the second threshold is discriminated. Here, "immediately before an image region" is before a period in which the primary transfer bias having the transfer voltage volume determined in the PTVC is applied and the image region (region of the photosensitive drum 1 on which the toner image is formable) of the photosensitive drum 1 with respect to a surface movement direction of the photosensitive drum 1.

In S104, discrimination is made as "Yes" (the transfer current value of not more than (10 μA), the controller 110 discriminates whether or not the VD offset has already been executed (S105). In the case where the controller 110 discriminates that the VD offset is not executed ("No") in S105, the controller 110 executes the VD offset and increases the back contrast (S106). As a result, the fog at the white background portion is suppressed, so that the generation of the positive ghost is suppressed.

Figure 8:
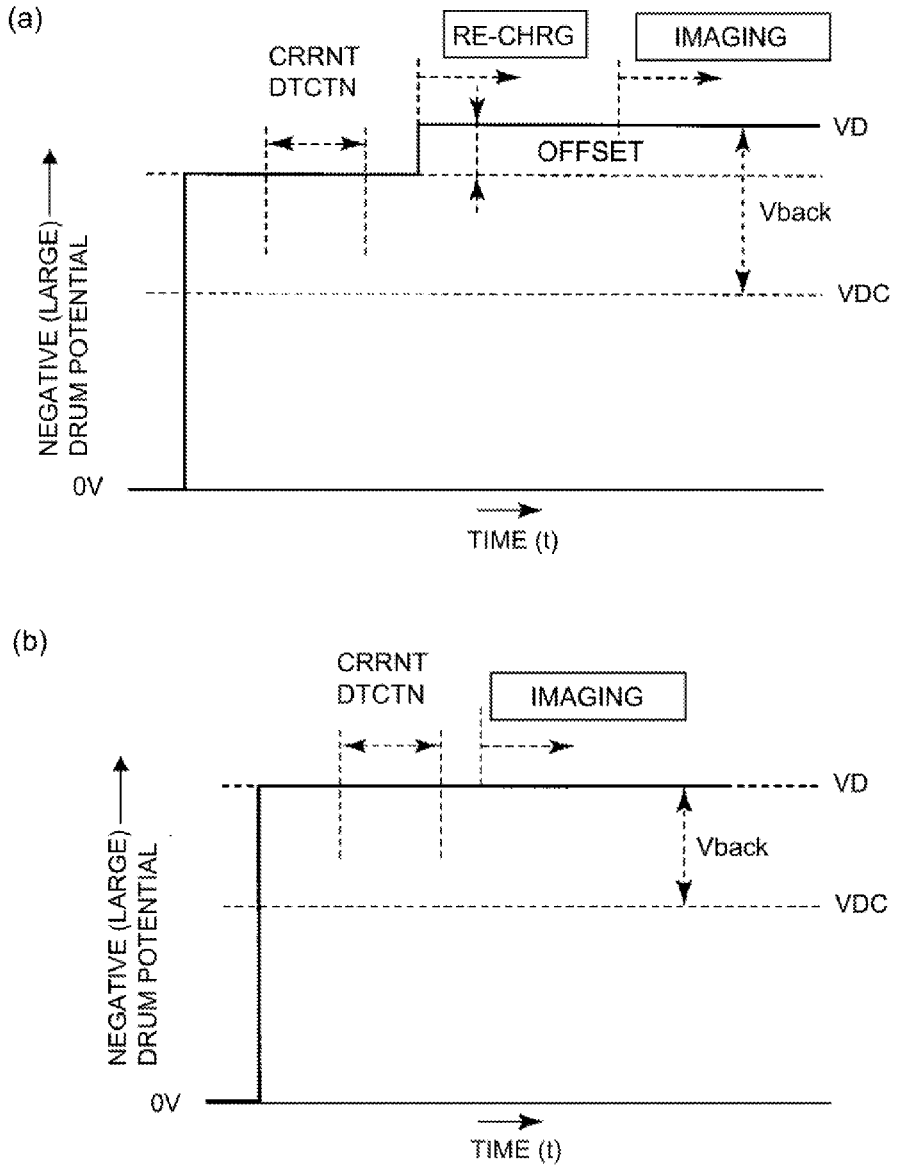
In FIG. 8, (a) and (b) are time charts each showing a sequence of positive ghost suppression control in Embodiment 1.

In FIG. 8, (a) is a time chart showing a potential relationship from S103 to S107 in the case where the VD offset is executed (in a VD offset sequence. As shown in the figure, before the image formation (specifically before the electrostatic image formation), a sequence for offsetting the charge potential VD to increase the back contrast which is the potential difference between the charge potential VD and the developing bias Vdc is performed. Specifically, a sequence in which the charging bias applied to the charging roller 2 is offset (made large in absolute value toward the negative side) and the photosensitive drum 1 is re-charged is performed. In this embodiment, the charge potential VD is offset by 20 V, so that the photosensitive drum 1 is re-charged through one-full circumference thereof.

Then, the photosensitive drum 1 is re-charged after the VD offset as described above and after the image formation is executed (S107), the image formation is ended (S108).

On the other hand, in the case where discrimination that the VD offset has already been executed ("Yes") in S105 is made, the controller 110 does not effect further VD offset, and executes the image formation at potential setting at which the VD offset has already been made (S107), and thereafter the image formation is ended (S108). This is because the VD offset has already been executed and the charge potential is made larger than a normal back contrast by 20 V, and therefore when the back contrast is further increased, there is a possibility that an inconvenience such as carrier deposition on the photosensitive drum 1 generates. In FIG. 8, (b) is a time chart showing a potential relationship from S103 to S107 in the case where the VD offset is not executed (in a normal sequence).

In S102, discrimination that the transfer voltage volume is less than 3.5 kV ("No") is made, the controller 110 discriminates whether or not the VD difference has already been executed (S109). In the case where the VD offset is not executed, the image formation is executed (S107), and thereafter the image formation is ended (S108). In the case where the VD offset has already been executed, the controller 110 returns the value of the charge potential VD, which has already been offset, to an original value (S110). Then, after the image formation is executed (S107), the image formation is ended (S108). Here, also in the case where the offset charge potential VD is returned to the original value (S110), similarly as in the case where the VD offset is effected (S106), a sequence in which the VD offset value is returned to the original value and then the photosensitive drum 1 is re-charged (through one-full circumference thereof in this embodiment) is performed.

By such an operation, even when the transfer current value is smaller than the predetermined value and thus the positive ghost is liable to generate is formed, the fog at the white background portion is suppressed by adjusting the back contrast, so that the generation of the positive ghost can be suppressed.

Here, the resistance value of the primary transfer roller 5 largely changes depending on a temperature and humidity in an environment in which the primary transfer roller 5 is placed. For that reason, after an integrated print number of sheets subjected to the image formation exceeds a predetermined print number, the PTVC is effected. Further, with respect to the resistance value of the primary transfer roller 5 when the last PTVC is executed, the resistance value of the primary transfer roller 5 lowers in some cases due to an environmental change or the like. In this case, there is a possibility that the transfer voltage volume and the transfer current value relative to the first threshold and the second threshold, respectively, are different. Accordingly, in this embodiment, the offset charge potential VD is returned to the original value in the manner described above. That is, the PTVC is effected every predetermined print number, and the offset charge potential VD is returned to the original value and thereafter the image formation is effected. In this embodiment, ever time when the integrated print number reaches 100 sheets, the PTVC is executed.

In this embodiment, the second threshold was 10 μA. This is because in the image forming apparatus 100 in this embodiment, the positive ghost starts to slightly generate when the transfer current value is 10 μA or less. However, the second threshold is not limited thereto, but may appropriately set at a transfer current value, at which the positive ghost is liable to generate, depending on a constitution, a condition and the like of the image forming apparatus 100.

Further, in this embodiment, the VD offset value was set at 20 V so that the positive ghost can be sufficiently suppressed in the image forming apparatus 100 in this embodiment. However, the VD image form value is not limited thereto, but may appropriately be set depending on the constitution, the condition and the like of the image forming apparatus 100 so that the positive ghost can be sufficiently suppressed.

As described above, in this embodiment, the controller 110 executes the VD offset as the positive ghost suppressing control in the following case. That is, the VD offset is executed in the case where the set transfer voltage volume is not less than the first threshold and the transfer current value detected by the current detecting circuit 121 when the primary transfer bias having the set transfer voltage volume is applied to the primary transfer roller 5 by the primary transfer voltage source E3 is not more than the second threshold. As a result, depending on whether or not the transfer voltage volume is not less than the first threshold, it is possible to discriminate whether or not a value of a current necessary to prevent the positive ghost from generating can be ensured by the PTVC. Then, depending on whether or not the transfer current value is not more than the second threshold, it is possible to specifically discriminate whether or not the positive ghost generates. Here, the current value compared with the second threshold may preferably be detected by the current detecting circuit 121 in a period in which the image region (specifically the toner image formed on the photosensitive drum 1) with respect to the surface movement direction of the photosensitive drum 1. This is because in the image region, the detected current value varies in some cases depending on the toner image formed at the exposed portion (light portion) or the like. In order to accurately discriminate whether or not the situation is such a situation that the positive ghost is liable to generate, it is preferable that the current value detected immediately before the image region free from such an influence is used.

Further, in this embodiment, in the case where the condition does not conform to the above-described condition, the VD offset is not executed or the charge potential VD which has already been offset is returned to the value before the offset. This is because when the VD offset is effected under a condition in which the positive ghost does not generate, the back contrast increases more than necessary and thus there is a possibility that the inconvenience such as the carrier deposition on the photosensitive drum 1 generates. That is, in this embodiment, the VD offset is not made during normal operation but is made only in the case where the transfer current decreases to the extent that there is a possibility that the positive ghost generates.

Further, the positive ghost is liable to generate due to the potential non-uniformity, of the photosensitive drum 1 at the downstream image forming portion S, generating when the toner image formed at the upstream image forming portion S passes through the primary transfer portion N1 of the downstream image forming portion S. Accordingly, of the plurality of image forming portions, at the most upstream image forming portion SY with respect to the surface movement direction of the intermediary transfer belt 7, the positive ghost does not readily generate. For that reason, the VD offset which is the positive ghost suppressing control in this embodiment may also be made at only at least one image forming portion downstream of the most upstream image forming portion SY with respect to the surface movement direction of the intermediary transfer belt 7. The VD offset may also be made at all of the image forming portions downstream of the most upstream image forming portion SY.

As described above, according to this embodiment, even in the image forming apparatus employing the DC charging type and the pre-exposure-less type for realizing the cost reduction and the like, it is possible to prevent the generation of the positive ghost due to the phenomenon that the transfer current value is small and thus a desired charged potential cannot be obtained. For example, the generation of the positive ghost can be suppressed even in the case where a high voltage capacity becomes insufficient with use of the primary transfer roller 5 and thus the transfer current becomes insufficient.

[Embodiment 2]

Another embodiment of the present invention will be described. Basic constitution and operation of an image forming apparatus in this embodiment are the same as those in Embodiment 1. Accordingly, elements having the same or corresponding functions and constitutions as those for the image forming apparatus in Embodiment 1 are represented by the same reference numerals or symbols, and will be omitted from detailed description.

In Embodiment 1, whether or not the VD offset should be executed was discriminated depending on whether or not a result of detection, by the current detecting circuit 121, of the transfer current value when the primary transfer bias having the transfer voltage volume determined in the PTVC is not more than the second threshold. On the other hand, in this embodiment, the detection, by the current detecting circuit 121, of the transfer current value when the primary transfer bias having the transfer voltage volume determined in the PTVC is not made. Instead thereof, in this embodiment, the transfer current value is estimated from a voltage-current characteristic of voltages Vα, Vβ, Vθ of a plurality of levels obtained in the PTVC and currents Iα, Iβ, Iθ at that time correspondingly, and then whether or not the VD offset should be executed is discriminated.

Figure 9:
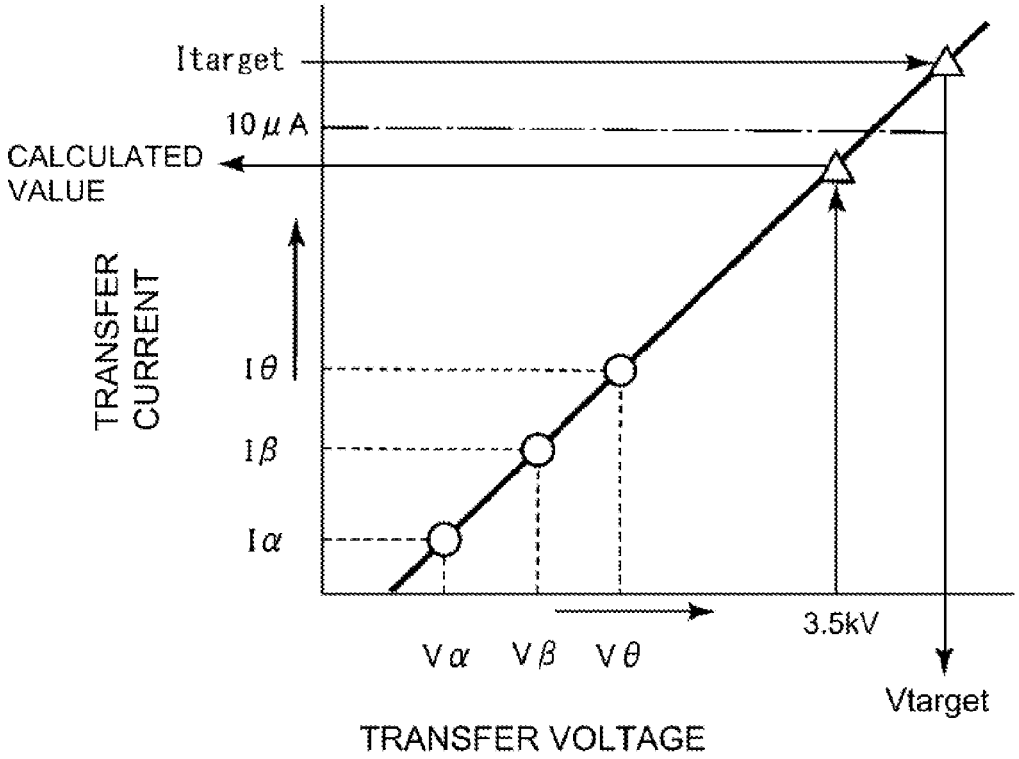
FIG. 9 is a graph for illustrating a calculating method of a transfer current value in Embodiment 2.

That is, in this embodiment, similarly as in Embodiment 1, from the voltage-current characteristic obtained in the PTVC, a target voltage value (Vtarget) correspond to a target current value (Itarget) calculated. In the case where a calculation value of the target voltage value (Vtarget) exceeds 3.5 kV which is the upper limit of the output of the primary transfer voltage source E3, the upper limit (3.5 kV) is determined as the transfer voltage value. Here, in this embodiment, as shown in FIG. 9, from the voltage-current characteristic obtained in the PTVC, the transfer current value correspond to the transfer voltage volume of 3.5 kV is calculated. Further, in this embodiment, the calculated value of the transfer current value (calculation result) and 10 μA which is the second threshold similar to that in Embodiment 1 are compared, and in the case where the calculated value of the transfer current value is not more than the second threshold, the VD offset is executed.

Figure 10:
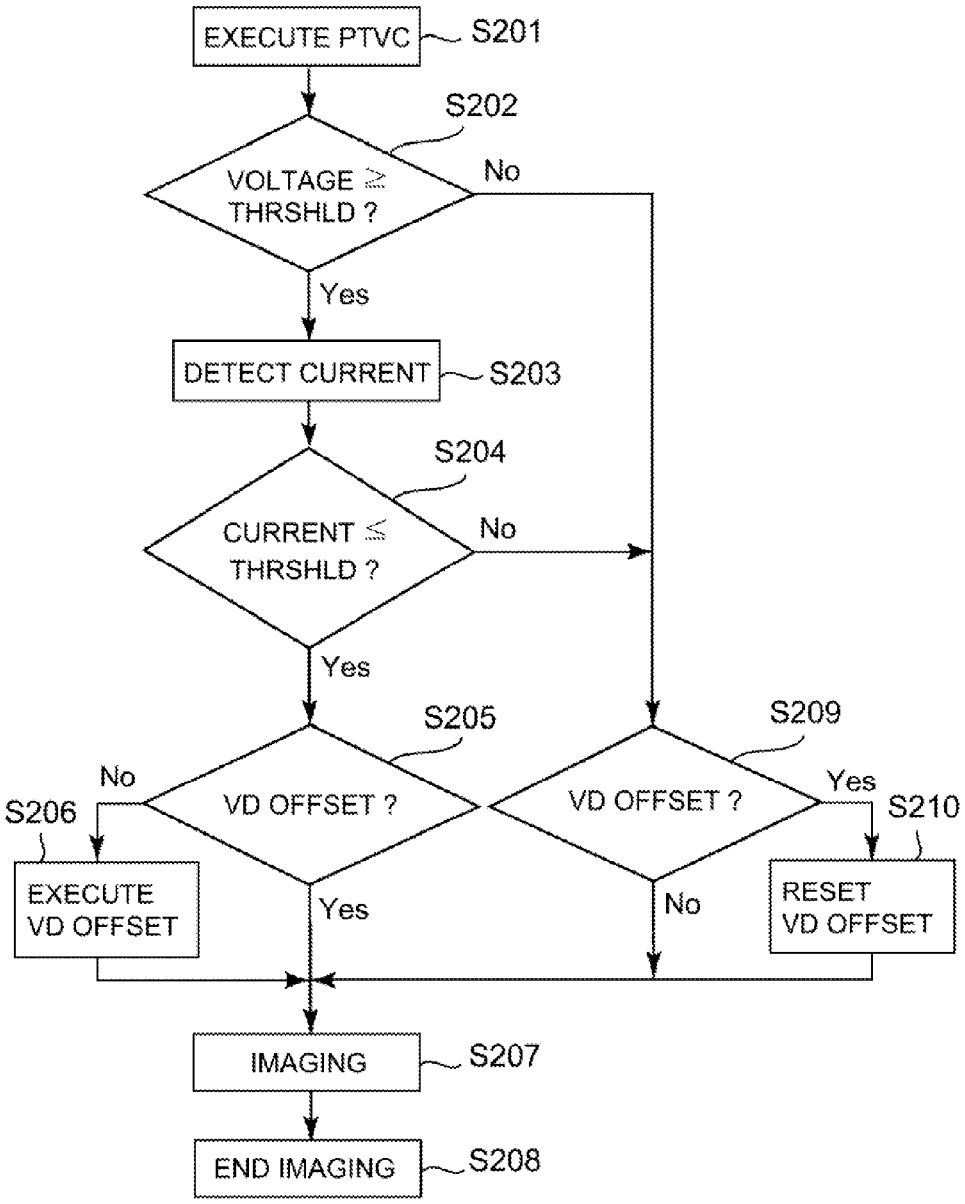
FIG. 10 is a flowchart of an operation in Embodiment 2.
Figure 11:
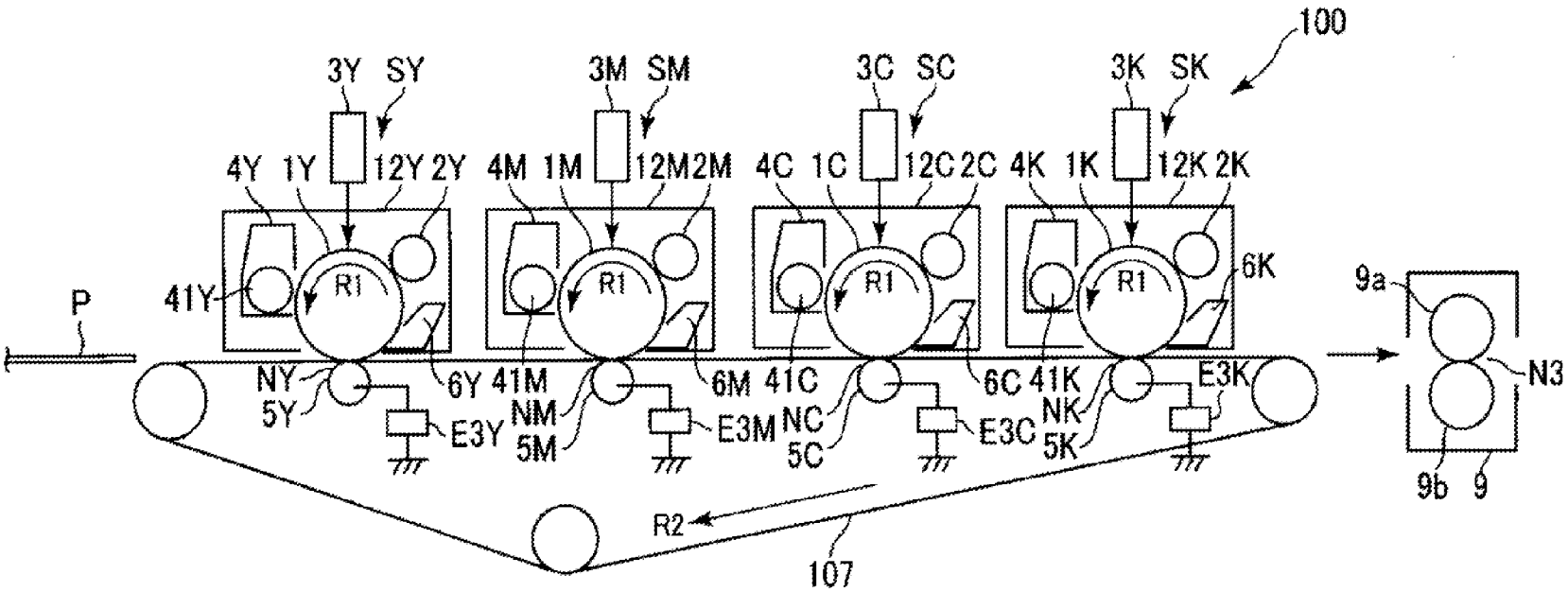
FIG. 11 is a schematic sectional view of a principal part of another example of the image forming apparatus.

FIG. 10 is a flowchart showing an outline of a flow of the operation of the image forming apparatus including the positive ghost suppressing control in this embodiment.

First, the controller 110 executes the PTVC in advance of the image formation (S201). Then, the controller 110 discriminates whether or not the transfer voltage volume (high voltage set value of the primary transfer bias) determined by the PTVC is not less than a predetermined first threshold (S202). Specifically, in this embodiment, whether or not the target voltage value (Vtarget) correspond to the target current value (Itarget) calculated in the PTVC is not less than 3.5 kV which is the upper limit of the output of the primary transfer voltage source E3 is discriminated.

In S202, in the case where the constitution is made as "Yes" (the transfer voltage volume of not less than 3.5 kV), the controller 110 obtains the calculated value of the transfer current flowing when the voltage of the first threshold (3.5 kV) is applied as shown in FIG. 9 (S203). Then, the controller 110 compares the calculated value of the transfer current with 10 μA which is the third threshold and discriminates whether or not the transfer current value detected by the current detecting circuit 121 is not more than a predetermined second threshold (S204).

Subsequently, processes of S205-S210 are similar to those of S105-S110 in Embodiment 1.

Thus, in this embodiment, whether or not the transfer current value obtained from the voltage-current characteristic in the PTVC is not more than the second threshold is discriminated. As in Embodiment 1, when the transfer current value immediately before the image formation is actually detected by the current detecting circuit 121, whether or not the positive ghost generates can be accurately discriminated, so that control with high precision can be effected. However, in this case, in order to start image formation after execution of the VD offset, there is a need that first, the photosensitive drum 1 is charged at the set value of a current charge a potential VD for detecting the transfer current value and then the VD offset is executed, and thereafter the photosensitive drum 1 is re-charged. On the other hand, by discriminating whether or not the VD offset should be executed on the basis of the calculated value of the transfer current as in this embodiment, it is possible to suppress the positive ghost without providing downtime (period in which the image formation cannot be effected) due to the detection of the transfer current value.

As described above, according to this embodiment, although the accuracy is somewhat lower than that in Embodiment 1, the control for suppressing the positive ghost can be effected in a shorter time, and it is possible to obtain an effect similar to that in Embodiment 1.

[Other Embodiments]

The present invention was described above based on the specific embodiments, but is not limited to the above-described embodiments.

For example, in the above-described embodiments, the case where the charging member contacted the photosensitive member was described. However, the charging member such as the charging roller is not necessarily be contacted to the surface of the photosensitive member as a member-to-be-charged, but if electric discharge at a close portion can be made, the charging member may also be disposed in non-contact with an closely to the photosensitive member with a gap (spacing) of, e.g., several 10 μm. In this way, the present invention is applicable to also a constitution in which the photosensitive member is electric charged by the electric discharge at the close portion (correspond to gaps upstream and downstream of the contact portion between the charging roller and the photosensitive member in the above-described embodiments).

In the above-described embodiments, the image forming apparatus of the intermediate transfer type was described as an example, but the present invention is also applicable to an image forming apparatus of a direct transfer type. FIG. 10 is a schematic sectional view of a principal part of the image forming apparatus of the direct transfer type. In FIG. 10, elements having the same or corresponding functions or constitutions are represented by the same reference numerals or symbols. The image forming apparatus 100 in FIG. 10 includes, in place of the intermediary transfer belt 7, a recording material carrying belt 107 constituted by an endless belt as a recording material carrying member. The recording material carrying belt 107 carries and feeds the recording material P as a transfer-receiving member onto which the toner image is transferred from the photosensitive member at the transfer portion. In the image forming apparatus 100 in FIG. 10, each of toner images formed on the photosensitive drums 1 at the image forming portions S is transferred at the transfer portions N onto the recording material P carried and fed on the recording material carrying belt 107 by the action of the transfer voltage applied to the transfer roller 5. In such an image forming apparatus 100 of the direct transfer type, in order to set the transfer roller bias applied from the transfer voltage source E3 to the transfer roller 5 during the image formation, at the transfer portion, the transfer bias control similar to those in the above-described embodiments is effected during non-image formation (when the recording material does not passes through the transfer portion). Accordingly, with respect to the transfer portion N, the present invention is applied, so that effects similar to those in the above-described embodiments can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-044096 filed on Mar. 5, 2015, which is hereby incorporated by reference herein in its entirety.;

What is claimed is:

1. An image forming apparatus comprising:

a photosensitive member;

a charging device supplied with a DC bias and configured to electrically charge said photosensitive member;

a developing device configured to develop, into a toner image, an electrostatic latent image formed on said photosensitive member charged by said charging device;

an intermediary transfer member onto which the toner image is transferred from said photosensitive member;

a transfer roller configured to transfer the toner image from said photosensitive member onto said intermediary transfer member;

a transfer bias applying device configured to apply a bias to said transfer roller;

a current detecting sensor configured to detect a current flowing through said transfer roller; and a controller configured to control a transfer bias applied to said transfer roller during image formation on the basis of a transfer bias which is determined, correspondingly to a bias causing a predetermined target current to flow through said transfer roller, on the basis of a predetermined test bias applied to said transfer roller during non-image formation and a value of a current flowing through said transfer roller under application of the predetermined test bias, wherein when the determined transfer bias exceeds a predetermined upper limit, said controller sets the transfer bias applied to said transfer roller during the image formation at the upper limit, and wherein in a same environmental condition, in a first case that the transfer bias applied to said transfer roller during the image formation is set at a value less than the predetermined upper limit, said controller executes an operation in a first mode in which an absolute value of a charging bias applied to said charging device is set at a first bias, and in a second case that the transfer bias applied to said transfer roller during the image formation is set at the predetermined upper limit and that a current-voltage characteristic of said transfer roller is such that value of a current flowing through said transfer roller under application of the upper limit transfer bias to said transfer roller is not more than the predetermined target current, said controller executes an operation in a second mode in which the absolute value of the charging bias applied to said charging device is set at a second bias larger than the first bias.

2. The image forming apparatus according to claim 1, wherein in the first case, said controller sets, at a first potential difference, a potential difference between a developing DC bias applied to said developing device and a dark-portion potential of said photosensitive drum charged by said charging device, and in the second case, said controller sets, at a second potential difference larger than the first potential difference, the potential difference between the developing DC bias applied to said developing device and the dark-portion potential of said photosensitive drum charged by said charging device.

3. The image forming apparatus according to claim 1, wherein only the DC bias is applied to said charging device.

4. The image forming apparatus according to claim 1, wherein in the first case, an absolute value of a charge potential of said photosensitive drum charged by said charging device during the image formation is a first potential, and in the second case, the absolute value of the charge potential of said photosensitive drum charged by said charging device during the image formation is a second potential higher than the first potential.

5. The image forming apparatus according to claim 1, wherein in a case that the transfer bias applied to said transfer roller during the image formation is set at the upper limit, when a current flowing through said transfer roller under application of the upper limit transfer bias to said transfer roller before the image formation is detected by said current detecting sensor, in a case that the current detected by said current detecting sensor is not more than a predetermined current, said controller sets the absolute value of the charging bias applied to said charging device is set at the second bias larger than the first bias, and in a case that the current detected by said current detecting sensor is more than the predetermined current, said controller sets the absolute value of the charging bias applied to said charging device is set at the first bias.

6. The image forming apparatus according to claim 1, further comprising a plurality of image forming portions each including said photosensitive member, said charging device, said developing device, said transfer roller, said transfer bias applying device, and said current detecting sensor, said image forming portions being provided along a movement direction of said intermediary transfer member, wherein said controller executes the operations in the first and second modes at said image forming portions provided downstream of the most upstream image forming portion with respect to the movement direction of said intermediary transfer member, and dose not execute the operations in the first and second modes the most upstream image forming portion with respect to the movement direction of said intermediary transfer member.

* * * * *